United States Patent [19]

Blaser et al.

[11] 4,349,286

[45] Sep. 14, 1982

[54] KEYBOARD ASSEMBLED FROM INDIVIDUAL KEYS

[75] Inventors: Paul Blaser; Helmut Schmidt, both of VS-Villingen; Walter Strobel, Unterkirnach, all of Fed. Rep. of Germany

[73] Assignee: Kienzle Apparate GmbH, Villingen, Fed. Rep. of Germany

[21] Appl. No.: 13,293

[22] Filed: Feb. 21, 1979

[30] Foreign Application Priority Data

Feb. 18, 1978 [DE] Fed. Rep. of Germany ..... 2807061

[51] Int. Cl.[3] ..... B41J 5/08

[52] U.S. Cl. ..... 400/492; 400/475; 400/472; 400/479

[58] Field of Search ..... 400/472, 474, 479, 479.1, 400/479.2, 490, 491, 491.1, 491.2, 492, 495, 495.1; 340/365 R, 365 VL, 365 C; 235/145 R; 200/5 E, 5 R; 178/17 C

[56] References Cited

U.S. PATENT DOCUMENTS

| | | | |
|---|---|---|---|
| 3,169,701 | 2/1965 | Dombrowski | 400/490 X |
| 3,890,480 | 6/1975 | Berling et al. | 400/479 X |
| 3,900,712 | 8/1975 | Fukao | 400/479.1 X |
| 3,962,556 | 6/1976 | Kravchuck | 400/479 X |
| 4,124,313 | 11/1978 | Schmidt et al. | 400/491.2 |
| 4,158,130 | 6/1979 | Speraw et al. | 235/146 |

FOREIGN PATENT DOCUMENTS

| | | |
|---|---|---|
| 2336083 | 2/1975 | Fed. Rep. of Germany . |
| 578243 | 11/1974 | Switzerland . |

OTHER PUBLICATIONS

Sales Literature, "Kienzle Daten Systeme", '3000'.

*Primary Examiner*—Edward M. Coven
*Attorney, Agent, or Firm*—Toren, McGeady & Stanger

[57] ABSTRACT

A keyboard which can be assembled from individual keys is disclosed. The individual keys include a key button, a key shaft for switching electric circuits, a stationary key body, and a spring for influencing the relative movement between the key shaft and key body. A base structure having cutouts is provided for receiving the keys. A circuit board carrying control elements cooperates with the key arrangement. The key buttons have several receiving openings for the key shafts. The cutouts in the base structure and the arrangement of the control elements on the circuit board are staggered relative to each other from row to row by a half spacing.

1 Claim, 9 Drawing Figures

KEYBOARD ASSEMBLED FROM INDIVIDUAL KEYS

FIELD OF THE INVENTION

The invention relates to a keyboard which can be assembled from individual keys.

BACKGROUND OF THE INVENTION

The German Auslegeschrift No. 24 62 035 describes a key arrangement which makes it possible to assemble keyboards of the most varied configurations from a minimum number of equal components. For example, the components described in this case make it possible to build an entire keyboard so that an alphabetic keyboard is arranged on the left-hand side, a numerical keyboard and, in addition, one or more blocks of function keys on the right-hand side. However, in the same manner, it should also be possible, for example, to arrange the alphabetic keyboard in the middle or on the right-hand side, and a block of function keys and a numerical keyboard on the left-hand side. In view of the fact that users usually have different requirements concerning organization, it is advantageous to use a modular concept for the system, so that all such wishes of the users can be realized by always employing the same components.

Accordingly, the keyboard according to the abovementioned German Auslegeschrift No. 24 62 035 consists of keys which are each to be mounted individually and are assembled on a keyboard on a base structure. Underneath the base structure, there is arranged a circuit board which carries the electrical control elements.

Another disadvantage of the known key arrangement is that the arrangement of the electrical control elements on the circuit board must correspond to the desired key arrangement. In other words, for each desired configuration of the entire keyboard, a special circuit board must be provided. When it is considered that this is a relatively expensive module which must be constructed by printed circuit techniques and must possibly be equipped with a plurality of induction windings, it becomes clear that the standardization of the circuit board is a major concern.

There are, however, difficulties concerning this standardization since there exists certain standard regulations for the arrangement of the keys within a block of alphabetic keys as well as for the arrangement of the blocks of numerical keys. It is often difficult to make these regulations compatible. As is well known, in the blocks of numerical and function keys, such keys are usually arranged in rows and columns without being staggered. However, in the blocks of alphabetic keys, this is not the case. In the latter case, the individual rows of keys are staggered relative to each other to a certain extent. For example, the standard prescribes that the second to the lowest row of keys be staggered relative to the lowest row of keys by a half spacing, while the third row of keys be only staggered by a quarter spacing relative to the second row of keys. In accordance with the standard, the last row of keys i.e., the fourth row of keys, in turn, is staggered by a half spacing relative to the third row of keys.

In summary, it is the object of the invention to provide a keyboard in which the staggering of the individual keys from row to row may vary between zero and a half spacing.

SUMMARY OF THE INVENTION

The invention starts from a keyboard which can be assembled from individual keys, comprising keys including a key button, a key shaft for switching electric circuits, a stationary key body and a spring for influencing the relative movement between key shaft and key body. Also included are a base structure for receiving the keys, the base structure being provided with cutouts which are arranged with uniform spacing in two dimensions, and a circuit board carrying electric control elements. The key buttons are provided with several receiving openings for the key shafts and the cutouts in the base structure, and the arrangement of the control elements on the circuit board are staggered relative to each other from row to row by a half spacing.

The inventive arrangement of the control elements on the circuit board and the corresponding design of the key buttons has the advantage that the circuit board can remain the same for all desired configurations of keyboards, so that the expenses for realizing even the most varied keyboards can be significantly reduced even further.

For a better understanding of the present invention, reference is made to the following description and accompanying drawings, while the scope of the present invention will be pointed out in the appended claims.

DESCRIPTION OF THE PREFERRED EMBODIMENTS

Figure 1:
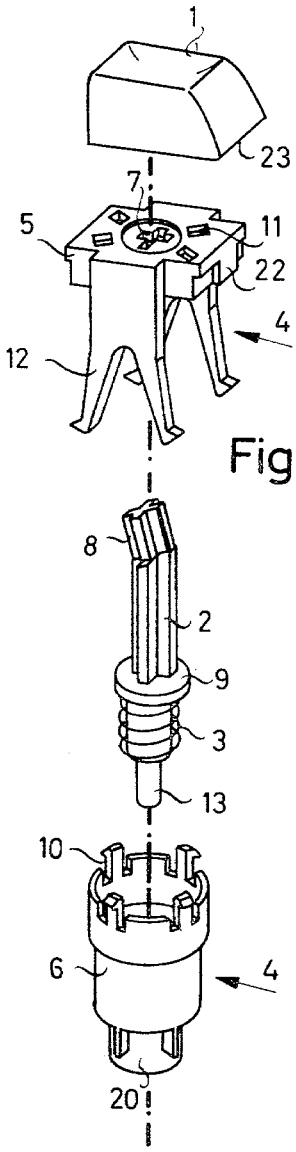
FIG. 1 shows an exploded view of the key which is to be mounted as a separate component.

As shown in FIG. 1, each key consists of a key button 1, a key shaft 2, a spring 3 and a stationary key body 4. The key body 4 consists of a top part 5 and a bottom part 6. The top part 5 has a cutout 7 which is adjusted to the shape of the key shaft 2 and serves for passing through the upper portion 8 of the key shaft. In addition, the key shaft 2 is provided with a flange 9, one end of the spring 3 bearing against this flange 9. The other end of the spring bears against the bottom of the lower part 6 of the key body 4. The lower part 6 is at its upper edge provided with detents 10 which engage cutouts 11 of the upper part 5. In addition, the upper part 5 of the key body 4 is provided with elongate detents 12 by means of which the keys are attached to the base structure 30, as will be explained below. At the key shaft 2, there is arranged a control element in the form of a ferrite pin 13. When the key is actuated by pressing the key button 1, the spring 3 is compressed and the ferrite pin 13 emerges from the key body 4 and passes through an electric circuit board which will also be described below.

Figure 4:
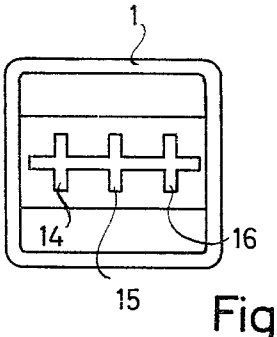
FIG. 4 shows a bottom view of the key button.

Referring to FIG 4, at its bottom side 23, the key button 1 is provided with cutouts 14, 15 and 16 which are arranged next to each other. The cutout 15 is arranged in the center of the key button 1, while the cutouts 14 and 16 to the left and right are arranged at equal distances therefrom. The distance between the cutouts 15 and 16, on the one hand, and 14 and 15, on the other hand, is a quarter spacing in each case, i.e., a quarter of the distance from the center of one key button 1 to the center of the next key button 1 in the same row (dimension a of FIGS. 6 and 7).

Figure 3A:
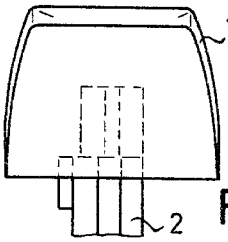
FIGS. 3*a* to 3*c* show front views of the key buttons.
Figure 2:
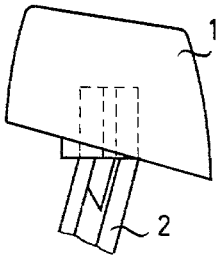
FIG. 2 shows a partial side view of the key.
Figure 3B:
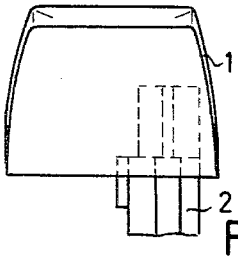
Figure 3C:
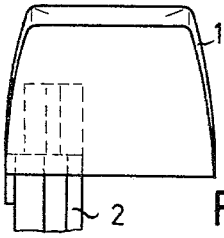

FIGS. 3*a* to 3*c* nearly show that it is posible to connect the key button 1 to the key shaft 2 in three different positions in accordance with the cutouts 14, 15 and 16. In the case of FIG. 3*a*, the key button is mounted on the shaft 2 by means of its cutouts 15 in the middle while, according to FIGS. 3*b* and 3*c*, the right or left cutout 16 or 14 serves to receive the key button 1 on the key shaft 2. Accordingly, by properly attaching the key button, it is possible to obtain a staggering of up to a half space of the dimension a. Each key is a unit which can be completely assembled in itself. The assembly of the key is obtained by first sliding the spring 3 onto the key shaft 2 in such a manner that it bears with one end against the flange 9. Subsequently, the key shaft 2 is inserted in the lower part 6 of the key body 4 and then the upper part 5 is mounted so that the upper portion 8 of the key shaft 2 is passed through the cutout 7 until the detents 10 engage the cutouts 11 of the upper part 5.

The keys are mounted in a base structure 30, wherein each row of these keys is assigned to a common key carrier 17. Each of these key carriers has the shape of a rail which is bent to a U-shaped cross-section. At its bottom, the rail has for each key a central cutout 18 and, surrounding each cutout 18, four cutouts 19. The cutouts 18 have the purpose of receiving the projection 20 of the lower part 6 of the key body 4. During assembly, the detents 12 of the upper part 5 of the key body 4, on the other hand, are passed through the cutouts 19. This is done in such a manner that the cutouts 19 always receive the detents 12 of two adjacent key bodies 4. In each of its perpendicularly extending walls 20, the key carrier 17 has recesses 21. These recesses 21 correspond to projections 22 at the upper part 5 of the key body 4, so that the key bodies 4 are fixed, in addition to the cutouts 18, in these recesses 21.

Figure 5:
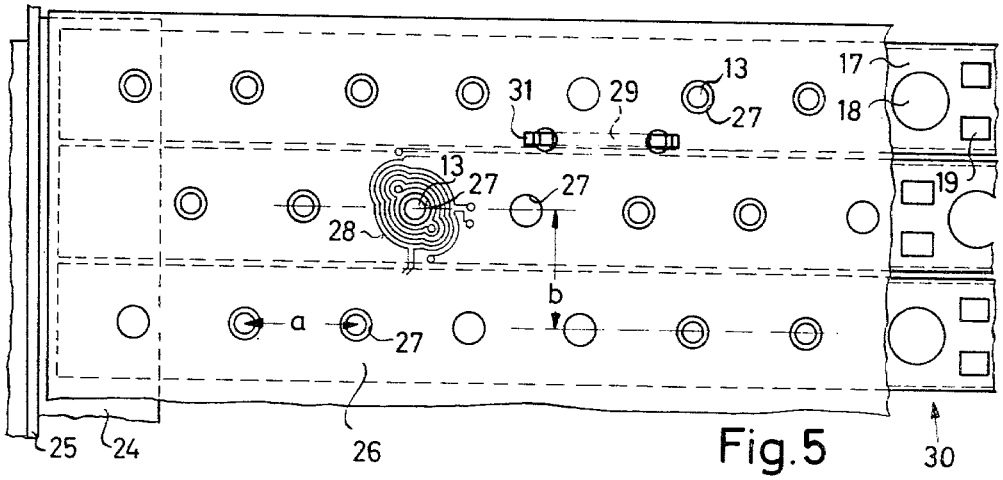
FIG. 5 shows a partial bottom view of the entire keyboard.
Figure 6:
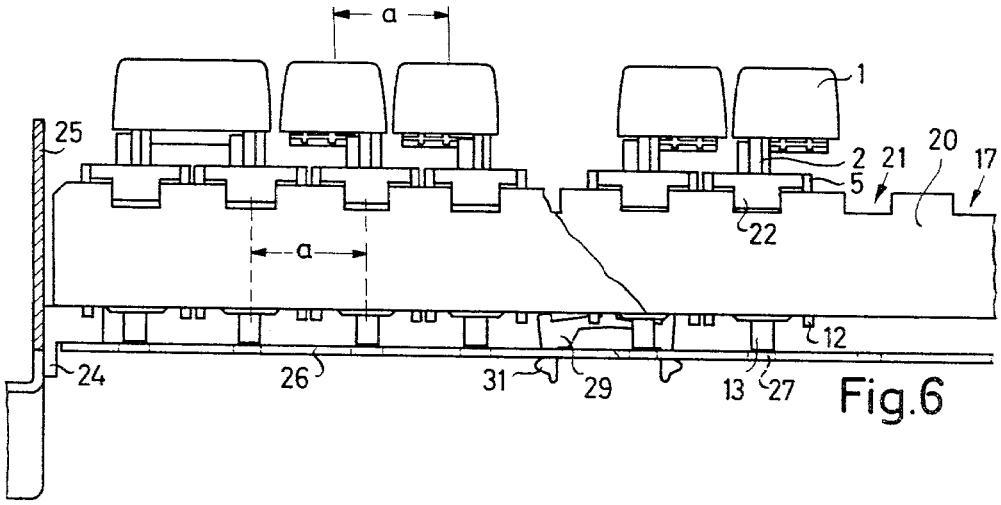
FIG. 6 shows a partial side view of the keyboard.

The bottom side 23 of the key button 1 has about equal length and width, resulting in an essentially square surface. FIG. 6 shows the dimension a which corresponds to the spacing of the keys in a row. The lateral length of the lower end surface 23 of the key buttons 1 essentially corresponds to the dimension a which, in turn, essentially corresponds to the dimension b shown in FIGS. 5 and 7. This represents the spacing of the keyboard from row to row, i.e., from the center of one key to the center of the next key.

A plurality of key carriers 17 are mounted next to each other to two rails 24 which are arranged on lateral plates 25, i.e. the support plates for the keyboard. The circuit board 26 is also mounted on these rails 24. This circuit board 26 may carry electric contacts or may be equipped with any other electrical control elements. In the present case, a printed wiring board 26 is provided with a cutout 27 for all possible key arrangements. The cutouts 27 within a row of keys have a spacing a, and the cutouts 27 of the next row of keys have a spacing b relative thereto. Around each cutout 27, there is provided on the printed wiring board a plurality of windings 28. The currents which flow through these windings 28 are amplified by the ferrite pin 13 at the key shafts 2 when the respective key is in the pressed position. For simplicity's sake, not all windings 28 on the circuit board 26 are shown in FIG. 5, but only one for a single cutout 27, as an example. The circuit board 26 is prevented from bending through toward the keys by means of spacers 29 which, with their two projections 31, are passed through the circuit board 26, on the one hand, and are supported by corresponding recesses of the key carriers 17, on the other hand.

Figure 7:
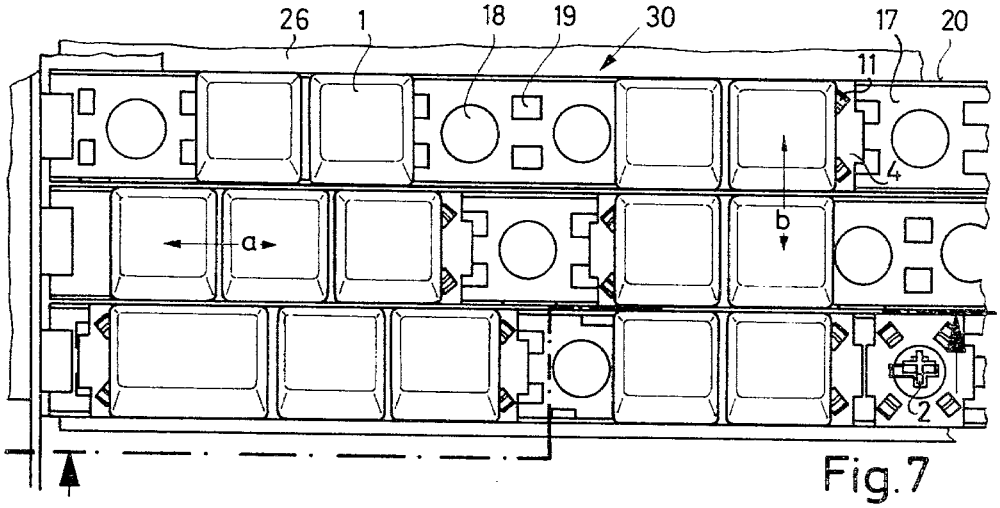
FIG. 7 shows a partial top view of the keyboard.

The cutouts 27 in the circuit board 26 as well as the cutouts 18 and 19 in the key carriers 17 are each staggered from row to row by half the dimension a (FIGS. 5 to 7).

With the aid of FIGS. 6 and 7, it shall now be explained that, by means of the three different cutouts 14 to 16 in the key buttons 11 and the above-mentioned staggering of the cutouts 18, 19 and 27 by a half spacing, it is possible to realize key arrangements which can be staggered relative to each other from row to row by between zero and a half spacing. The left portion of FIG. 7 shows an alphabetic arrangement of keys, i.e., with key buttons which are staggered relative to each other from row to row. As FIG. 6 shows, the key buttons 1 in the lowest row are placed in such a manner that they are mounted on the key shafts 2 with their outermost cutouts 16 on the right. It can be seen that the corresponding key body 4 becomes visible at the side of key button 1.

The second to the lowest row of keys in FIG. 7 must be staggered by a half spacing relative to the keys of the lowest row. This results in the same arrangement of the key buttons on the key bodies as in the lowest row, because the cutouts 18, 19 and 27 in the key carriers 17 and the circuit board 26 in this row are staggered by a half spacing relative to the lowest row. On the other hand, in the third to the lowest row which, according to the standard for blocks of alphabetic keys, must in this case only be staggered by a quarter spacing relative to the row arranged therebelow, the key buttons 1 are concentrically placed on the key shafts 2, so that, in this case, the key bodies 4 are not visible. In this case, the staggering of the cutouts 18, 19 and 27, in turn, is a half spacing while, on the other hand, the standard only prescribes a staggering by a quarter spacing. This means that the key button 1 must be placed on the key shafts shifted by a quarter spacing relative to the second to the lowest row. According to the standard, the fourth row of keys from the bottom, not shown in FIG. 7, should again be staggered by a half spacing relative to the third to the lowest row. However, since in this case again the cutouts 18, 19 and 27 are staggered by a half spacing, in the fourth row, the key buttons are also placed concentrically on the key shafts. In summary, it can be said that, for realizing a block of alphabetic keys in the two lowest rows, the key buttons are placed on the key shafts 2 with their cutouts 16 on the right, while for realizing the two upper rows, they are placed with the cutouts 15 in the middle.

However, this is different in a block of keys as can be seen in FIG. 7 on the right-hand side. In this case, due to the staggering of the cutouts 18, 19 and 27 from row to row by a half spacing, the key buttons must be placed on the key bodies 4 staggered by a half spacing from row to row. In other words, in the lowest row, the key buttons must be placed on the key shafts 2 by means of the cutouts 16, in the second to the lowest row by means of the cutouts 14, and in the third to the lowest row again by means of the cutouts 16.

The above explanations make sufficiently clear that, by means of the arrangement of the key buttons as well as the circuit board, it is possible to assemble all types of key configurations, without having to use special components. In addition, it should be mentioned that, by means of the components in question, it is, of course, possible to realize even larger keys, for example, keys which cover $1\frac{1}{2}$ spacings (see FIGS. 6 and 7) or also keys which cover two and three spacings. In this case, these keys may, of course, be arranged in a single row and, thus, in a single key carrier 17, or they may also cover several key carriers 17. It is evident that for this approach, it is required that the double keys also have double the amount of cutouts 15 and 16 at their bottom sides.

While the foregoing description and drawings represent the preferred embodiments of the present invention, it will be obvious to those skilled in the art that various changes and modifications may be made therein without departing from the true spirit and scope of the present invention.

What is claimed is:

1. A keyboard assembled from individual keys, comprising:

(a) keys, including (i) a key button, (ii) a key shaft having said key button affixed thereto at one end, (iii) a stationary key body for receiving the other end of said key shaft, and (iv) a spring for influencing the relative movement between key shaft and key body;

(b) a base structure for receiving said keys, said base structure being provided with cutouts which are arranged with uniform spacing in two dimensions;

(c) a circuit board carrying electrical control elements being disposed on said base structure, said control elements adapted to being switched by operation of said key shafts;

(d) said key buttons having three receiving openings for said key shafts, one of said openings being arranged in the middle and the other two openings being arranged to the left and right thereof, said openings being arranged with respect to each other at a distance of a quarter of the lateral key-to-key spacing; and (e) said cutouts in said base structure and the arrangement of said control elements on said circuit board being arranged staggered relative to each other by a half spacing from row to row for selective use as alphabetic key sections or as key sections for numerical and function keys wherein said keys may be arranged to be staggered relative to each other from row to row from zero to at least a half spacing at discrete quarter-spaced intervals.

* * * * *